US009151115B1

(12) United States Patent
Forte, Jr.

(10) Patent No.: US 9,151,115 B1
(45) Date of Patent: Oct. 6, 2015

(54) STABILIZED LADDER ASSEMBLY

(71) Applicant: Michael Forte, Jr., Indianapolis, IN (US)

(72) Inventor: Michael Forte, Jr., Indianapolis, IN (US)

( * ) Notice: Subject to any disclaimer, the term of this patent is extended or adjusted under 35 U.S.C. 154(b) by 0 days.

(21) Appl. No.: 14/179,637

(22) Filed: Feb. 13, 2014

(51) Int. Cl.
*E06C 7/42* (2006.01)
*E06C 7/18* (2006.01)
*E06C 7/44* (2006.01)

(52) U.S. Cl.
CPC . *E06C 7/42* (2013.01); *E06C 7/188* (2013.01); *E06C 7/423* (2013.01); *E06C 7/44* (2013.01)

(58) Field of Classification Search
CPC ..... E06C 7/42; E06C 7/423; E06C 7/26; E06C 7/44; E06C 7/46; E06C 7/188
See application file for complete search history.

(56) References Cited

U.S. PATENT DOCUMENTS 1,735,992 A * 11/1929 Bode ..... 182/104
2,964,122 A * 12/1960 Funk et al. ..... 182/180.3
3,059,723 A * 10/1962 Shore ..... 182/107
3,174,584 A * 3/1965 Smith ..... 182/172
3,327,810 A * 6/1967 Johnson et al. ..... 182/17
3,508,628 A * 4/1970 Conrad ..... 182/172
4,155,424 A * 5/1979 Johnson ..... 182/152
5,226,504 A * 7/1993 Bumbera ..... 182/172
D406,652 S 3/1999 Marchand
5,918,698 A * 7/1999 Lunn ..... 182/107
6,116,379 A 9/2000 Huss
6,167,989 B1 * 1/2001 Jung ..... 182/172
6,902,036 B1 6/2005 Holley
6,959,785 B1 * 11/2005 Chilton ..... 182/107
2002/0074187 A1 6/2002 Bendle et al.
2011/0017549 A1 1/2011 Lietz
2011/0067954 A1 3/2011 Deal

* cited by examiner

*Primary Examiner* — Colleen M Chavchavadze

(57) ABSTRACT

A stabilized ladder assembly stabilizes a ladder by providing support on both sides of the ladder. The assembly includes a ladder having a first front side rail, a second front side rail, a first support leg, a second support leg and a plurality of rungs coupled to and extending between the first and second front side rails. A pair of support bars is provided. One of the support bars is coupled to and extends between the first front side rail and the first support leg. One of the support bars is coupled to and extends between the second front side rail and the second support leg. A cross member is coupled to and extends between the support bars. A pair of base supports is provided and each is configured to contact a ground surface. Each of the base supports is coupled to and extends downwardly from the cross member.

17 Claims, 5 Drawing Sheets

STABILIZED LADDER ASSEMBLY

BACKGROUND OF THE DISCLOSURE

Field of the Disclosure

The disclosure relates to ladder assemblies and more particularly pertains to a new ladder assembly for stabilizing a ladder by providing support on both sides of the ladder.

SUMMARY OF THE DISCLOSURE

An embodiment of the disclosure meets the needs presented above by generally comprising a ladder having a first front side rail, a second front side rail, a first support leg, a second support leg and a plurality of rungs coupled to and extending between the first and second front side rails. A pair of support bars is provided. One of the support bars is coupled to and extends between the first front side rail and the first support leg. One of the support bars is coupled to and extends between the second front side rail and the second support leg. A cross member is coupled to and extends between the support bars. A pair of base supports is provided and each is configured to contact a ground surface. Each of the base supports is coupled to and extends downwardly from the cross member.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
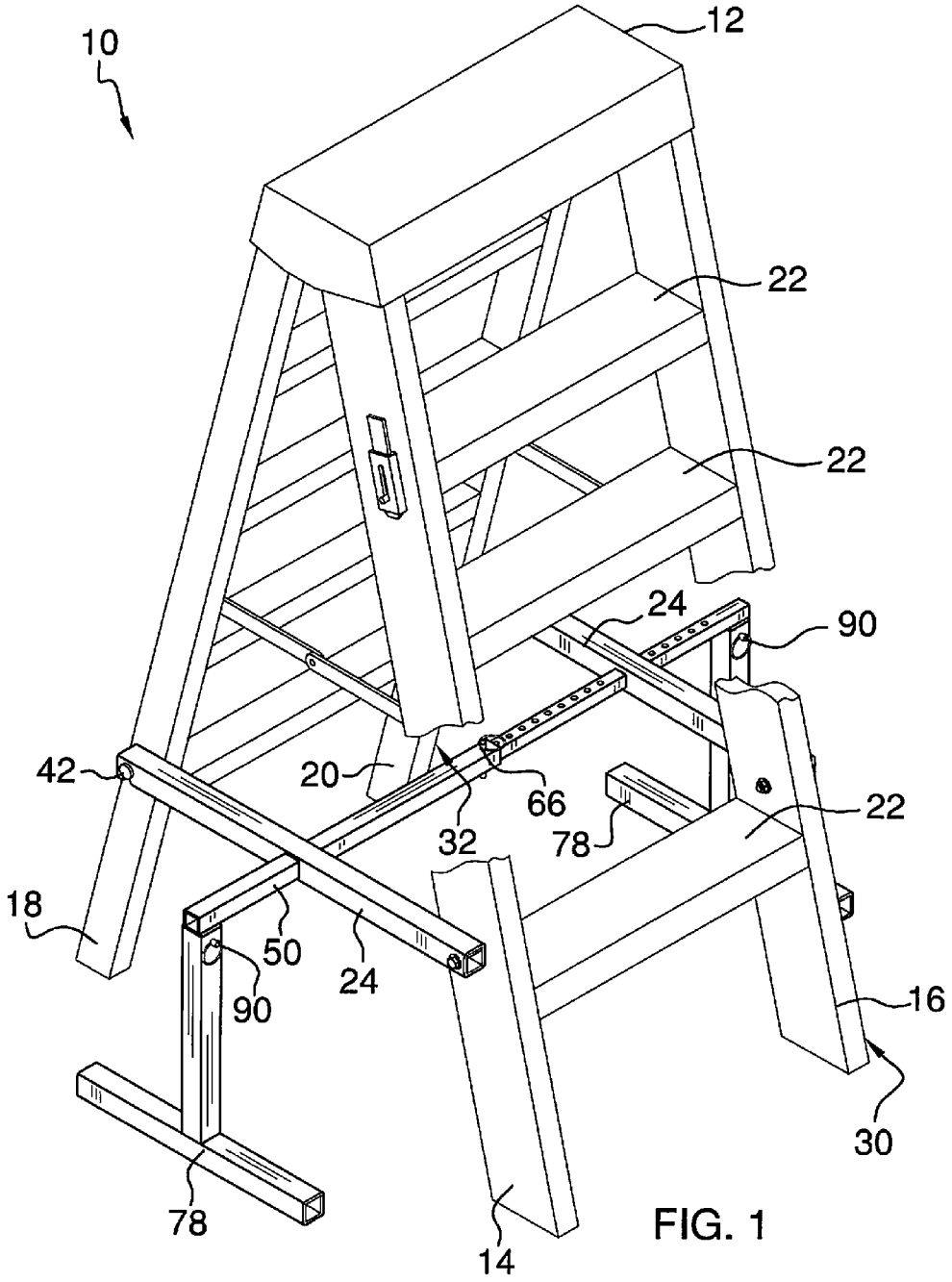
FIG. 1 is a top front side perspective view of a stabilized ladder assembly according to an embodiment of the disclosure.
Figure 2:
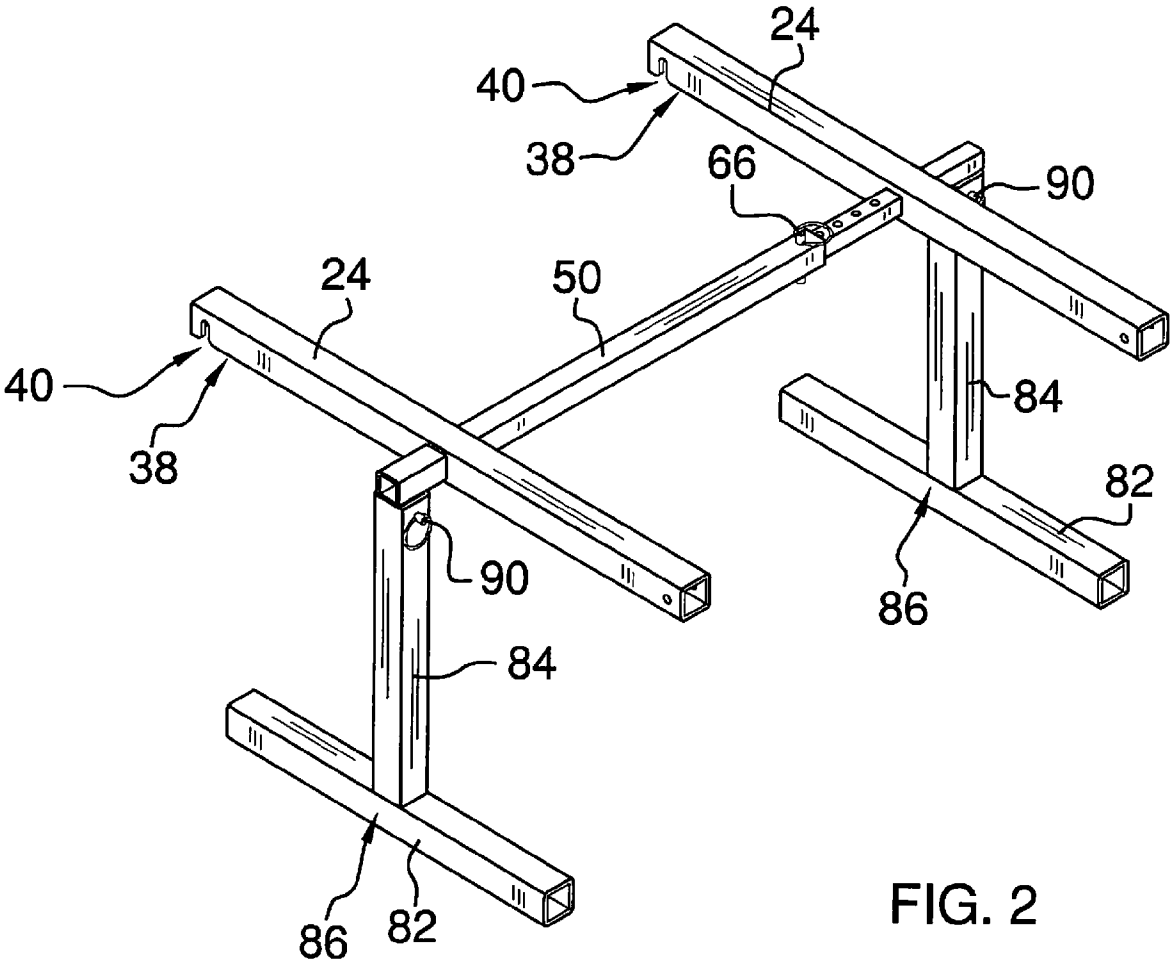
FIG. 2 is a top front side perspective view of an embodiment of the disclosure.
Figure 3:
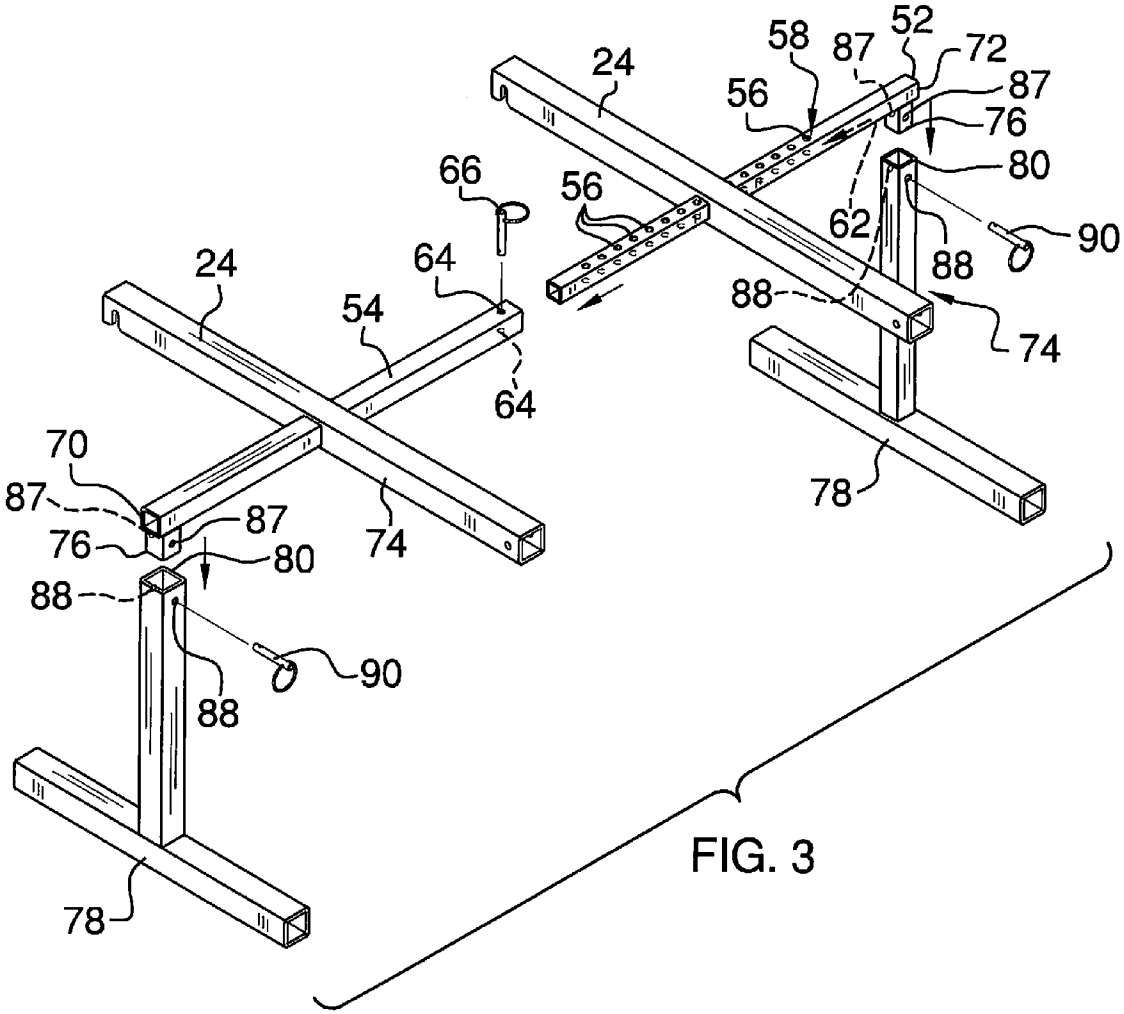
FIG. 3 is a partially-exploded top front side perspective view of an embodiment of the disclosure.
Figure 4:
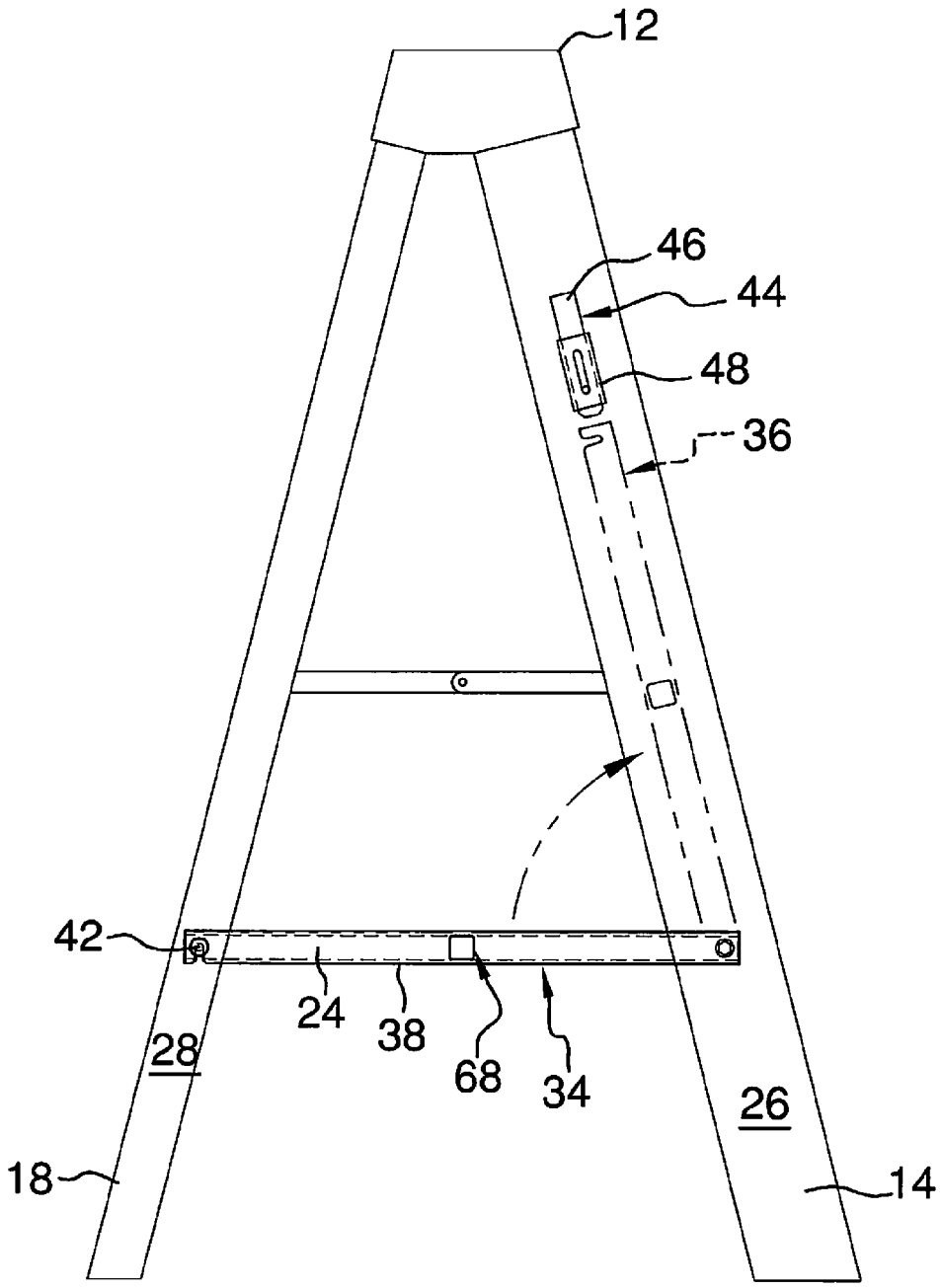
FIG. 4 is a side view of an embodiment of the disclosure shown with the base supports and cross member omitted.
Figure 5:
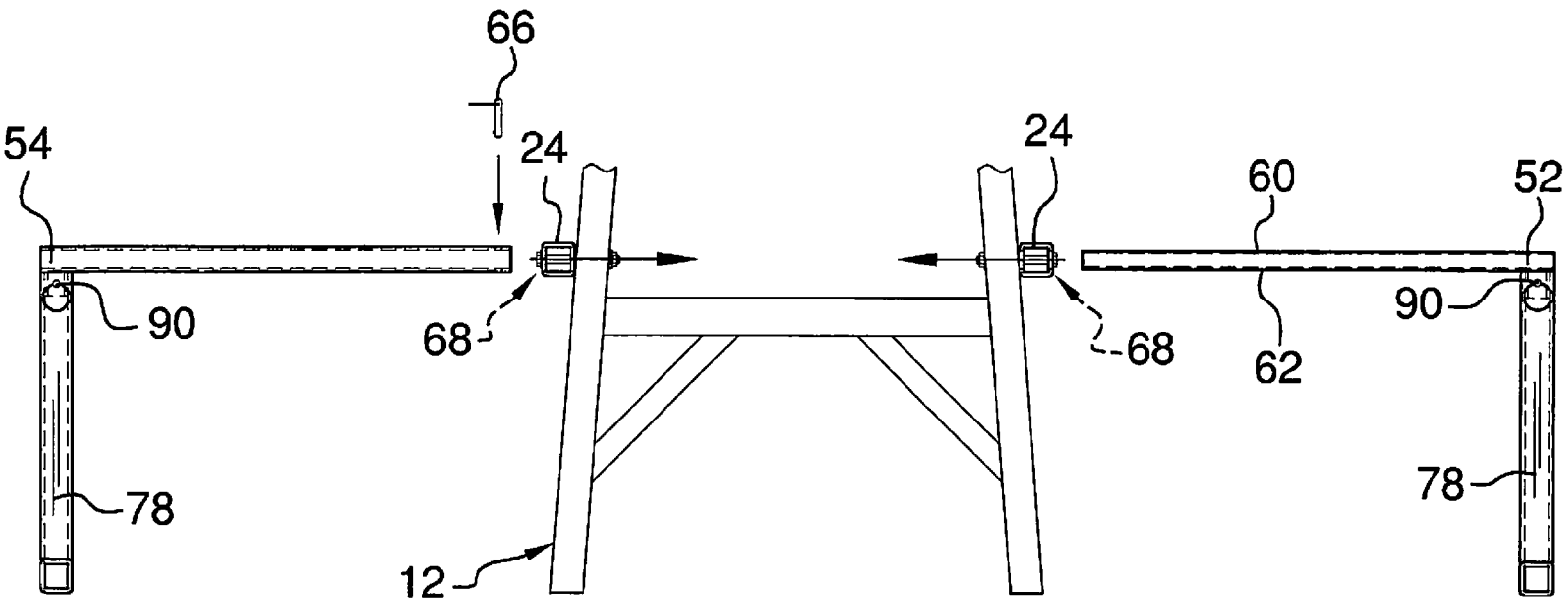
FIG. 5 is a front view of an embodiment of the disclosure.

With reference now to the drawings, and in particular to FIGS. 1 through 5 thereof, a new ladder assembly embodying the principles and concepts of an embodiment of the disclosure and generally designated by the reference numeral 10 will be described.

As best illustrated in FIGS. 1 through 5, the stabilized ladder assembly 10 generally comprises a ladder 12 having a first front side rail 14, a second front side rail 16, a first support leg 18, a second support leg 20 and a plurality of rungs 22 coupled to and extending between the first 14 and second 16 front side rails. The ladder 12 may be of any conventional design.

A pair of support bars 24 is provided. One of the support bars 24 is coupled to and extends between the first front side rail 14 and the first support leg 18. One of the support bars 24 is coupled to and extends between the second front side rail 16 and the second support leg 20. One of the support bars 24 is coupled to an outer surface 26 of the first front side rail 14 and an outer surface 28 of the first support leg 18. One of the support bars 24 is coupled to an outer surface 30 of the second front side rail 16 and an outer surface 32 of the second support leg 20. Each of the support bars 24 is pivotally coupled to the ladder 12 wherein the support bars 24 are pivotable between a use position 34 and a storage position 36. The support bars 24 are positioned transversely relative to the rungs 22 when the support bars 24 are in the use position 34. Each of the support bars 24 has a bottom end 38. A pair of notches 40 is provided and each of the notches 40 extends into the bottom end 38 of an associated one of the support bars 24. Each of the notches 40 is configured to engage a fastener 42 extending from the ladder 12 wherein the notches 40 are configured to retain the support bars 24 in the use position 34 when the fasteners 42 are received within the notches 40.

A pair of locking members 44 is coupled to the ladder 12. Although only one locking member 44 is shown in the drawings, it should be understood that a second locking member 44 is positioned on an outer surface 30 of the second front rail 16. Each of the locking members 44 is configured to engage an associated one of the support bars 24 when the support bars 24 are pivoted to the storage position 36. Each of the locking members 44 includes a lock 46 and a housing 48. Each lock 46 is slidably coupled to the associated housing 48 wherein each lock 46 is extendable and retractable into and out of the associated housing 48 to selectively secure the associated support bar 24 in the storage position 36.

A cross member 50 is coupled to and extends between the support bars 24. The cross member 50 may be positioned transversely relative to the support bars 24. The cross member 50 comprises a first sleeve section 52 and a second sleeve section 54. The first sleeve section 52 is telescopically received within the second sleeve section 54 such that the first sleeve 52 section is slidably positionable within the second sleeve section 54. A plurality of apertures 56 is positioned in the first sleeve section 52. The apertures 56 include an upper set 58 of apertures 56 positioned in a top section 60 of the first sleeve section 52 and a lower set 62 of apertures 56 positioned in a bottom section 62 of the first sleeve section 52. The upper 58 and lower 62 sets of apertures 56 are vertically aligned relative to each other. A pair of holes 64 is positioned in the second sleeve section 54. The holes 64 of the second sleeve section 54 are vertically aligned. A coupler 66 is extendable through and engages each of the holes 64 and a selectable pair of the apertures 56 in the first sleeve section 52. The coupler 66 may comprise a conventional locking pin or other conventional fastener. Each of the support bars 24 has a slot 68 positioned therein. Each of the slots 68 is configured to receive the cross member 50 therethrough such that a first end 70 and a second end 72 of the cross member 50 extends outwardly from an outer surface 74 of each associated support bar 24. A pair of tubular projections 76 is coupled to the cross member 50.

A pair of base supports 78 is provided. Each of the base supports 78 is coupled to and extends downwardly from the cross member 50. Each of the base supports 78 is configured to contact a ground surface. One of the base supports 78 is coupled to the cross member 50 proximate the first end 70 of the cross member 50. One of the base supports 78 is coupled to the cross member 50 proximate the second end 72 of the cross member 50. The cross member 50 is removably coupled to each of the base supports 78. A top end 80 of each of the base supports 78 defines an opening into an interior space of the associated base support 78 wherein each of the tubular projections 76 is positionable within the opening of an associated one of the base supports 78. Each of the base supports 78 has a planar bottom section 82 and a planar top section 84 wherein each of the base supports 78 is T-shaped. The planar top section 84 is coupled to and extends upwardly from a center 86 of the planar bottom section 82.

Each of the tubular projections 76 has a pair of holes 87 positioned therein. The holes 87 in each of the tubular projections 86 are spaced and horizontally aligned. A plurality of apertures 88 is provided. Each of the base supports 78 has a pair of the apertures 88 positioned therein proximate the top end 80 of the base support 78. A pair of connectors 90 is provided. Each of the connectors 90 is extendable through and engages the apertures 88 of an associated one of the base supports 78 and the holes 87 of an associated one of the tubular projections 76 when the associated tubular projection 76 is received within the associated base support 78. Each of the connectors 90 may comprise a conventional locking pin or similar fastener.

The assembly 10 may be constructed from metal, plastic or the like. Excluding the ladder 12, the assembly 10 may have a height between approximately 20.0 cm and 50.0 cm; a length between 85.0 cm and 130.0 cm; and a width between approximately 4.0 cm and 20.0 cm.

In use, as stated above and shown in the Figures, the support bars 24 are attached to the ladder 12 using screws or other conventional fasteners. The cross member 50 is slid through the slots 68 of the support bars 24 and the coupler 66 is used to lock the first 52 and second 54 sleeve sections relative to each other. The base supports 78 are attached to the cross member 50 using connectors 90. In this manner, the assembly 10 stabilizes the ladder 12 by providing support on both sides of the ladder 12 in order to help prevent the ladder 12 from tipping and/or rocking when a person is positioned on the ladder 12. This allows the person to perform a desired task on the ladder 12 without requiring that another person hold the ladder 12 steady.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A stabilized ladder assembly comprising:

a ladder having a first front side rail, a second front side rail, a first support leg, a second support leg and a plurality of rungs coupled to and extending between said first and second front side rails;

a pair of support bars, one of said support bars being coupled to and extending between said first front side rail and said first support leg, one of said support bars being coupled to and extending between said second front side rail and said second support leg;

a cross member coupled to and extending between said support bars, said cross member having a first end and a second end, each of said first end and said second end of said cross member being laterally spaced outwardly from an associated one of said support bars; and a pair of base supports, an uppermost end of each of said base supports being coupled to said cross member wherein each said base support extends downwardly from said cross member laterally spaced outwardly from an associated one of said support bars, each of said base supports being configured to contact a ground surface; and further comprising: a pair of tubular projections extending downwardly from said cross member; and a top end of each of said base supports defining an opening into an interior space of said associated base support wherein each of said tubular projections is insertable into said opening of an associated one of said base supports such that said cross member rests upon each said base support.

2. The assembly of claim 1, further comprising:

one of said base supports being coupled to said cross member proximate said first end of said cross member; and one of said base supports being coupled to said cross member proximate said second end of said cross member.

3. The assembly of claim 1, wherein said cross member is removably coupled to each of said base supports.

4. The assembly of claim 1, further comprising:

each of said tubular projections having a pair of holes positioned therein, said holes in each of said tubular projections being spaced and horizontally aligned;

a plurality of apertures, each of said base supports having a pair of said apertures being positioned therein proximate said top end of said base support; and a pair of connectors, each of said connectors being extendable through and engaging said apertures of an associated one of said base supports and said holes of an associated one of said tubular projections when said associated tubular projection is received within said associated base support.

5. The assembly of claim 4, further comprising each of said connectors comprising a locking pin.

6. The assembly of claim 1, further comprising each of said base supports having a planar bottom section and a planar top section wherein each of said base supports is T-shaped, said planar top section being coupled to and extending upwardly from a center of said planar bottom section.

7. The assembly of claim 1, further comprising each of said support bars having a slot positioned therein, each of said slots being configured to receive said cross member therethrough such that said first end and said second end of said cross member extends outwardly from an outer surface of each said associated support bar.

8. The assembly of claim 1, further comprising said cross member being positioned transversely relative to said support bars.

9. The assembly of claim 1, further comprising said cross member comprising a first sleeve section and a second sleeve section, said first sleeve section being slidably positionable within said second sleeve section.

10. The assembly of claim 9, further comprising:

a plurality of apertures positioned in said first sleeve section, said apertures including an upper set of apertures positioned in a top section of said first sleeve section and a lower set of apertures positioned in a bottom section of said first sleeve section, said upper and lower sets of apertures being vertically aligned relative to each other;

a pair of holes positioned in said second sleeve section, said holes of said second sleeve section being vertically aligned; and a coupler being extendable through and engaging each of said holes in said first sleeve section and a selectable pair of said apertures in said first sleeve section.

11. The assembly of claim 10, wherein said coupler comprises a locking pin.

12. The assembly of claim 1, further comprising:

one of said support bars being coupled to an outer surface of said first front side rail and an outer surface of said first support leg; and one of said support bars being coupled to an outer surface of said second front side rail and an outer surface of said second support leg.

13. The assembly of claim 1, further comprising each of said support bars being pivotally coupled to said ladder wherein said support bars are pivotable between a use position and a storage position, said support bars being positioned transversely relative to said rungs when said support bars are in the use position.

14. The assembly of claim 13, further comprising:

each of said support bars having a bottom end; and a pair of notches, each of said notches extending into said bottom end of an associated one of said support bars, each of said notches being configured to engage a fastener extending from said ladder wherein said notches are configured to retain said support bars in the use position when the fasteners are received within said notches.

15. The assembly of claim 13, further comprising a pair of locking members coupled to said ladder, each of said locking members being configured to engage an associated one of said support bars when said support bars are pivoted to the storage position.

16. The assembly of claim 15, further comprising each of said locking members including a lock and a housing, each said lock being slidably coupled to said associated housing wherein each said lock is extendable and retractable into and out of said associated housing for selectively securing said associated support bar in the storage position.

17. A stabilized ladder assembly comprising:

a ladder having a first front side rail, a second front side rail, a first support leg, a second support leg and a plurality of rungs coupled to and extending between said first and second front side rails;

a pair of support bars, one of said support bars being coupled to and extending between said first front side rail and said first support leg, one of said support bars being coupled to and extending between said second front side rail and said second support leg, one of said support bars being coupled to an outer surface of said first front side rail and an outer surface of said first support leg, one of said support bars being coupled to an outer surface of said second front side rail and an outer surface of said second support leg, each of said support bars being pivotally coupled to said ladder wherein said support bars are pivotable between a use position and a storage position, said support bars being positioned transversely relative to said rungs when said support bars are in the use position, each of said support bars having a bottom end;

a pair of notches, each of said notches extending into said bottom end of an associated one of said support bars, each of said notches being configured to engage a fastener extending from said ladder wherein said notches are configured to retain said support bars in the use position when the fasteners are received within said notches;

a pair of locking members coupled to said ladder, each of said locking members being configured to engage an associated one of said support bars when said support bars are pivoted to the storage position, each of said locking members including a lock and a housing, each said lock being slidably coupled to said associated housing wherein each said lock is extendable and retractable into and out of said associated housing to selectively secure said associated support bar in the storage position;

a cross member coupled to and extending between said support bars, said cross member having a first end and a second end, each of said first end and said second end of said cross member being laterally spaced outwardly from an associated one of said support bars, said cross member being positioned transversely relative to said support bars, said cross member comprising a first sleeve section and a second sleeve section, said first sleeve section being slidably positionable within said second sleeve section;

a plurality of apertures positioned in said first sleeve section, said apertures including an upper set of apertures positioned in a top section of said first sleeve section and a lower set of apertures positioned in a bottom section of said first sleeve section, said upper and lower sets of apertures being vertically aligned relative to each other;

a pair of holes positioned in said second sleeve section, said holes of said second sleeve section being vertically aligned;

a coupler being extendable through and engaging each of said holes and a selectable pair of said apertures in said first sleeve section, said coupler comprising a locking pin;

each of said support bars having a slot positioned therein, each of said slots being configured to receive said cross member therethrough such that said first end and said second end of said cross member extends outwardly from an outer surface of each said associated support bar;

a pair of tubular projections coupled to said cross member;

a pair of base supports, an uppermost end of each of said base supports being coupled to said cross member wherein each said base support extends downwardly from said cross member laterally spaced outwardly from an associated one of said support bars, each of said base supports being configured to contact a ground surface, one of said base supports being coupled to said cross member proximate said first end of said cross member, one of said base supports being coupled to said cross member proximate said second end of said cross member, said cross member being removably coupled to each of said base supports, a top end of each of said base supports defining an opening into an interior space of said associated base support wherein each of said tubular projections is insertable into said opening of an associated one of said base supports such that said cross member rests upon each said base support, each of said base supports having a planar bottom section and a planar top section wherein each of said base supports is T-shaped, said planar top section being coupled to and extending upwardly from a center of said planar bottom section;

each of said tubular projections extending downwardly from said cross member and having a pair of holes positioned therein, said holes in each of said tubular projections being spaced and horizontally aligned;

a plurality of apertures, each of said base supports having a pair of said apertures being positioned therein proximate said top end of said base support; and a pair of connectors, each of said connectors being extendable through and engaging said apertures of an associated one of said base supports and said holes of an associated one of said tubular projections when said associated tubular projection is received within said associated base support, each of said connectors comprising a locking pin.

* * * * *